US010900255B2

(12) United States Patent
Fink et al.

(10) Patent No.: US 10,900,255 B2
(45) Date of Patent: Jan. 26, 2021

(54) TAMPER RESISTANT GRAVITY LATCH

(71) Applicant: FATH, INC., Orlando, FL (US)

(72) Inventors: Armin Fink, Ocoee, FL (US); William Kenneth Williams, Lexington, NC (US); Joseph Oliva, Orlando, FL (US)

(73) Assignee: FATH, INC., Orlando, FL (US)

( * ) Notice: Subject to any disclaimer, the term of this patent is extended or adjusted under 35 U.S.C. 154(b) by 639 days.

(21) Appl. No.: 15/676,153

(22) Filed: Aug. 14, 2017

(65) Prior Publication Data

US 2018/0044941 A1 Feb. 15, 2018

Related U.S. Application Data

(60) Provisional application No. 62/375,209, filed on Aug. 15, 2016.

(51) Int. Cl.

| | |
|---|---|
| ***E05B 15/00*** | (2006.01) |
| ***B65F 1/16*** | (2006.01) |
| *E05B 63/24* | (2006.01) |
| *E05C 1/16* | (2006.01) |

(52) U.S. Cl.

CPC ..... *E05B 15/0093* (2013.01); *B65F 1/1615* (2013.01); *E05B 63/24* (2013.01); *E05C 1/16* (2013.01); *Y10T 292/0937* (2015.04); *Y10T 292/1063* (2015.04)

(58) Field of Classification Search

CPC .... E05B 63/24; E05B 15/0093; B65F 1/1615; Y10T 292/307; Y10T 292/308; Y10T 292/1079; Y10T 292/1018; Y10T 292/0937; Y10T 292/0938; Y10T 292/0916; Y10T 292/14; Y10T 292/1063; Y10T 292/1064; E05C 1/16; Y10S 292/37; Y10S 292/63

See application file for complete search history.

(56) References Cited

U.S. PATENT DOCUMENTS

| | | | | | |
|---|---|---|---|---|---|
| 26,518 | A | * | 12/1859 | Page | E05B 65/0864 292/153 |
| 2,918,318 | A | | 12/1959 | Sacharski | |
| 3,206,238 | A | * | 9/1965 | Speight | E05B 13/005 292/195 |
| 4,714,286 | A | * | 12/1987 | Yamamoto | A45C 5/00 292/252 |
| 4,865,368 | A | * | 9/1989 | McCall | E05B 65/5292 292/175 |
| 5,094,358 | A | | 3/1992 | Serio, Sr. | |

(Continued)

FOREIGN PATENT DOCUMENTS

| | | | | |
|---|---|---|---|---|
| DE | 2946095 | * | 5/1981 | |
| DE | 102007039351 | A1 | 11/2008 | |
| EP | 0831195 | A1 * | 3/1998 | B65F 1/1615 |

*Primary Examiner* — Carlos Lugo

(74) *Attorney, Agent, or Firm* — Wolter Van Dyke Davis, PLLC; Robert L. Wolter

(57) ABSTRACT

An apparatus, having: a staple (404); and a hasp assembly (200) including: a chamber (412) including a home position (430) and a release passage (414); and a release element (328) disposed in the release passage. Forward rotation of the hasp assembly from an upright orientation (208) about a first horizontal axis (220) allows the kinetic element to move under the influence of gravity from the home position into the release passage and into contact with the release element, thereby releasing the staple.

17 Claims, 11 Drawing Sheets

(56) References Cited

U.S. PATENT DOCUMENTS

| | | | | |
|---|---|---|---|---|
| 5,106,132 | A * | 4/1992 | Bako | E05B 65/5292 292/128 |
| D333,715 | S | 3/1993 | Mahler | |
| 5,482,334 | A * | 1/1996 | Hotzl | E05B 53/00 292/142 |
| 5,518,282 | A * | 5/1996 | Sawada | E05B 17/2011 292/252 |
| 5,551,737 | A * | 9/1996 | Clavin | E05B 83/30 292/169 |
| 5,673,810 | A | 10/1997 | Rothrock | |
| 5,735,428 | A | 4/1998 | Chern | |
| 5,738,395 | A | 4/1998 | Probst | |
| 5,772,264 | A | 6/1998 | Bettenhausen | |
| 6,257,030 | B1 * | 7/2001 | Davis, III | E05B 7/00 292/39 |
| 6,382,688 | B1 * | 5/2002 | Agostini | E05B 77/06 292/336.3 |
| 6,666,485 | B1 | 12/2003 | Moret | |
| 6,685,240 | B2 * | 2/2004 | Bacon | E05B 85/18 292/142 |
| 6,880,717 | B1 | 4/2005 | O'Conor | |
| 7,228,719 | B2 * | 6/2007 | Alchin | E05B 65/0858 292/199 |
| 7,540,393 | B2 | 6/2009 | Wong | |
| 8,191,953 | B2 * | 6/2012 | Simon | B60R 7/04 296/24.34 |
| 8,313,126 | B2 | 11/2012 | Ferkovichea | |
| 8,366,156 | B2 | 2/2013 | Mercier et al. | |
| 8,479,949 | B2 | 7/2013 | Henkel | |
| 8,550,282 | B1 | 10/2013 | Libhart et al. | |
| 8,960,735 | B2 * | 2/2015 | Michael | E05C 3/24 292/100 |
| 9,188,143 | B1 * | 11/2015 | Motherwell | E05C 3/30 |
| 9,376,255 | B2 | 6/2016 | Banik et al. | |
| 10,100,554 | B2 * | 10/2018 | Michael | E05B 15/0093 |
| 2003/0155366 | A1 | 8/2003 | Raghunathan | |
| 2007/0175898 | A1 | 8/2007 | Craft et al. | |
| 2011/0031765 | A1 | 2/2011 | Vazquez et al. | |
| 2013/0306637 | A1 | 11/2013 | Pallwitz | |
| 2014/0034645 | A1 | 2/2014 | Jackson | |
| 2015/0035288 | A1 | 2/2015 | Fink et al. | |
| 2016/0060898 | A1 * | 3/2016 | Michael | E05B 15/0093 292/200 |

* cited by examiner

TAMPER RESISTANT GRAVITY LATCH

BACKGROUND OF THE INVENTION

The present invention relates to latches for containers, and more particularly, to a latch for locking a lid to a body of a container.

It is known to for latches that lock containers lock the container when the container is in an upright orientation and unlock the container when the container is in an upside-down position upon being emptied. However, in the event that the container falls over on one of its sides prior to being emptied, such latches may prematurely unlock the container. Consequently, there remains room in the art for improvement.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

In describing particular features of different embodiments of the present invention, number references will be utilized in relation to the figures accompanying the specification. Similar or identical number references in different figures may be utilized to indicate similar or identical components among different embodiments of the present invention.

Figure 1:
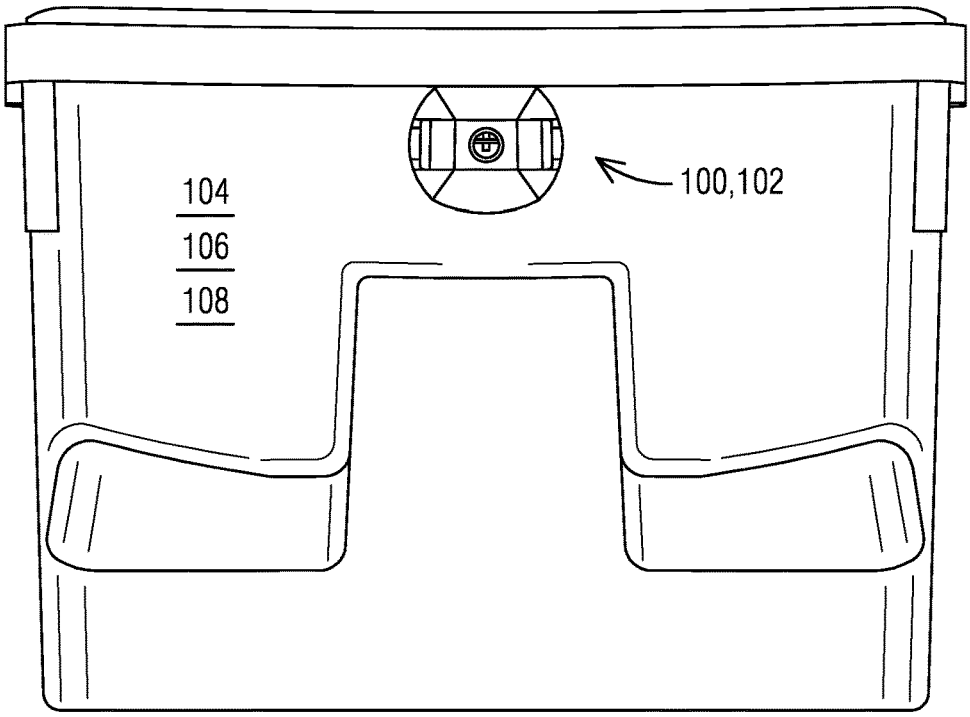
FIG. 1 shows a manual release mechanism of the latch assembly mounted to an exterior surface of a front of a container.

FIG. 1 shows a manual release mechanism 100 of a latch assembly 102 mounted to an exterior surface 104 of a front 106 of a container 108. In an embodiment, the container 108 includes a lid (not shown) that is hinged at a back of the container 108, and the container 108 is designed to be tilted forward to be emptied. Containers of this sort are often used to house common household waste. During a collection operation, a vehicle with a specialized apparatus grabs the container 108, lifts it, and then tilts it forward to empty the contents of the container into a receptacle on the vehicle. Accordingly, for this type of container the lid must automatically open when tilted forward from upright, but need not open when in other orientations. The manual release mechanism 100 enable a manual release of the lid regardless of an orientation of the container 108.

Figure 2:
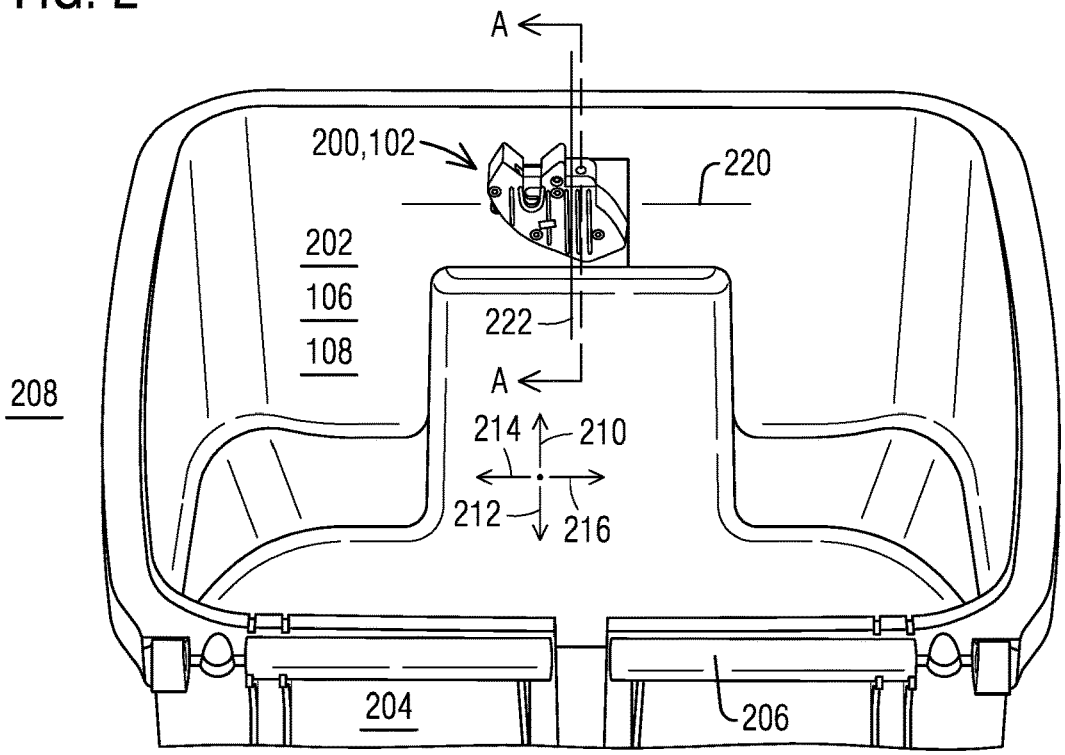
FIG. 2 shows a hasp assembly of the latch assembly mounted to an interior surface of the front of the container.

FIG. 2 shows a hasp assembly 200 of the latch assembly 102 mounted to an interior surface 202 of the front 106 of the container 108. It is equally possible to mount the hasp assembly 200 and manual release mechanism 100 at other locations in the container 108, including other locations in the front 106 as well as the sides. At a rear 204 of the container 108 is a hinge 206 for the lid (not shown). The manual release mechanism 100 and the hasp assembly 200 make up an apparatus for securing a container 108.

In FIG. 1 and FIG. 2, the container 108 is shown in an upright orientation 208 from which the container 108 may rotate in a forward direction 210, a backward direction 212, a sideways left direction 214, and a sideways right direction 216. The rotational directions are shown with arrows and refers to a direction of movement experienced by the hasp assembly 200 when the container 108 is rotated from the upright orientation 208. As such, the hasp assembly 200 moves in the directions shown as the hasp assembly 200 rotates with the container 108. If the container 108 is tilted forward while remaining on the ground, the hasp assembly 200 rotates around a remote first axis (not shown) located at a base of the container 108.) If the container 108 is tilted during a collection operation, the container 108 and hasp assembly 200 will rotate with the specialized assembly of the collection vehicle about a different first axis. However, all first axes are parallel to each other, regardless of their respective locations. Similarly, sideways rotation would be around a horizontal second axis that is perpendicular to the first axis 220 (when viewed from above looking down). If the container is tilted from upright by, for example, wildlife or weather, the second axis may be located at a base of the container.

Although unlikely, it is possible for the hasp assembly 200 to rotate in place. In such an instance, forward and backward rotation would be around a horizontally oriented axis such as, for example, first axis 220. Similarly, sideways rotation would be around a horizontal axis that is perpendicular to the first axis 220 such as, for example, second axis 222.

A staple (not shown) is secured to the lid, and the hasp assembly 200 is configured to engage the staple, thereby holding the lid closed.

The hasp assembly 200 will only release the staple (and the lid) if the manual release mechanism 100 is manually activated, or if the container 108 is rotated from the upright orientation 208 in the forward direction 210 beyond a forward threshold angle and with sufficient speed. If the container 108 is rotated in the backward direction 212 or in one of the sideways directions 214, 216, the hasp assembly 200 will retain the staple therein and "lock" the hasp assembly200. Once locked, the hasp assembly 200 must be "reset" by returning the container 108 (and attached hasp assembly 200) to the upright orientation 208 before rotation in the forward direction 210 will be effective to release the staple.

Figure 3:
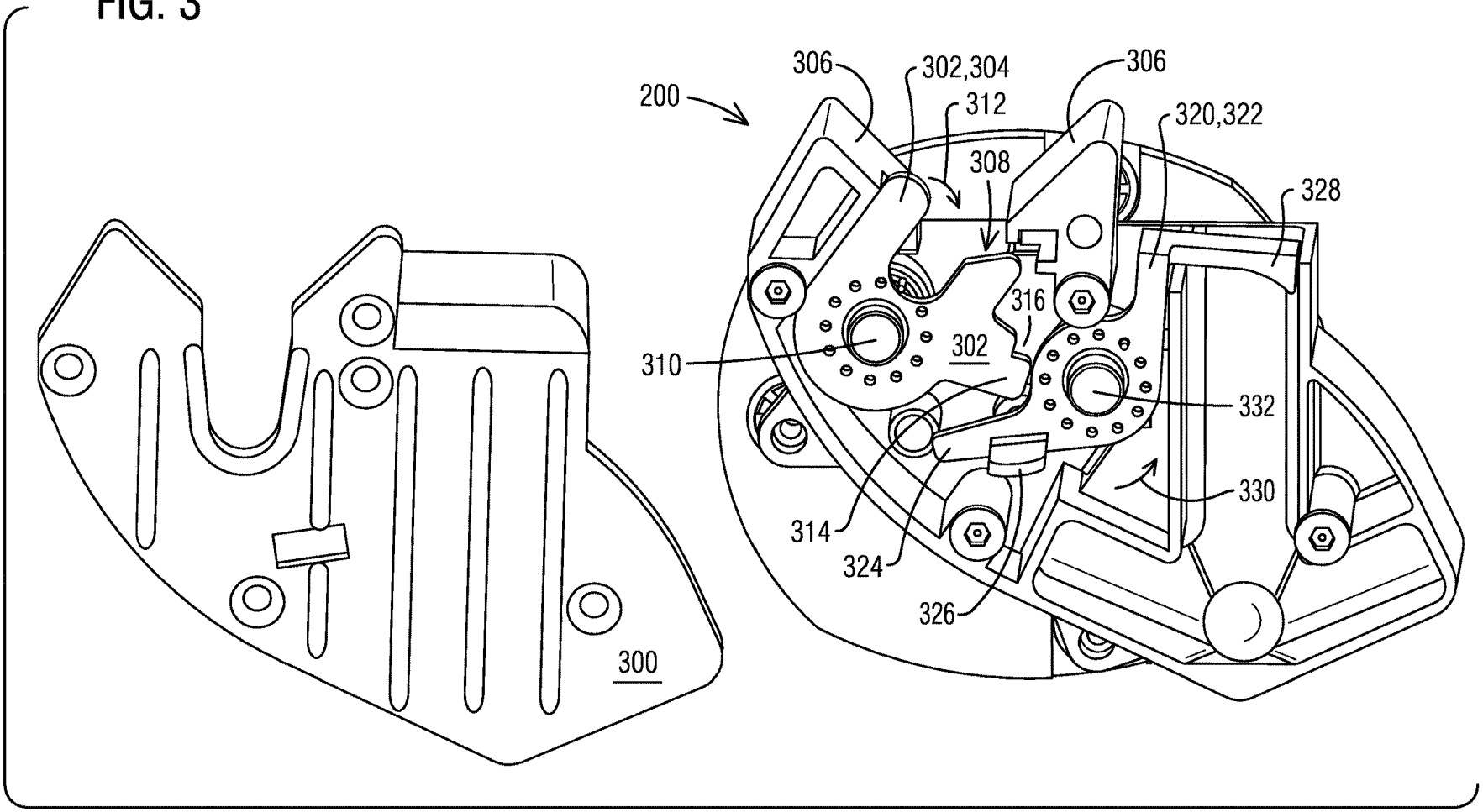
FIG. 3 shows the hasp assembly of FIG. 2 with a cover removed and a hasp in a disengaged position.

FIG. 3 shows the hasp assembly 200 of FIG. 2 with a cover 300 removed and a hasp 302 that is biased into a disengaged hasp position 304 by, for example, a coil spring (not visible) behind the hasp 302. Optional ramps 306 guide the staple into the hasp 302 as the lid is closed. Once the staple abuts a contact area 308 of the hasp 302, continued lowering of the lid (and staple) causes the hasp 302 to rotate about a hasp stud 310 in a clockwise direction 312. The hasp 302 includes a hasp tab 314 and a hasp recess 316.

An actuator 320 is biased into a disengaged actuator position 322 by, for example, a coil spring (not visible) behind the actuator 320. The actuator 320 includes an actuator catch 324 an internal release tab 326, and a release element 328. As the hasp 302 rotates in the clockwise direction 312 the hasp tab 314 contacts the actuator catch 324, and continued rotation of the hasp 302 causes the actuator 320 to rotate in a counterclockwise direction 330 about an actuator stud 332.

The cover 300 include an internal side opening 340 through which the internal release tab 326 projects when the cover 300 is assembled.

Figure 4:
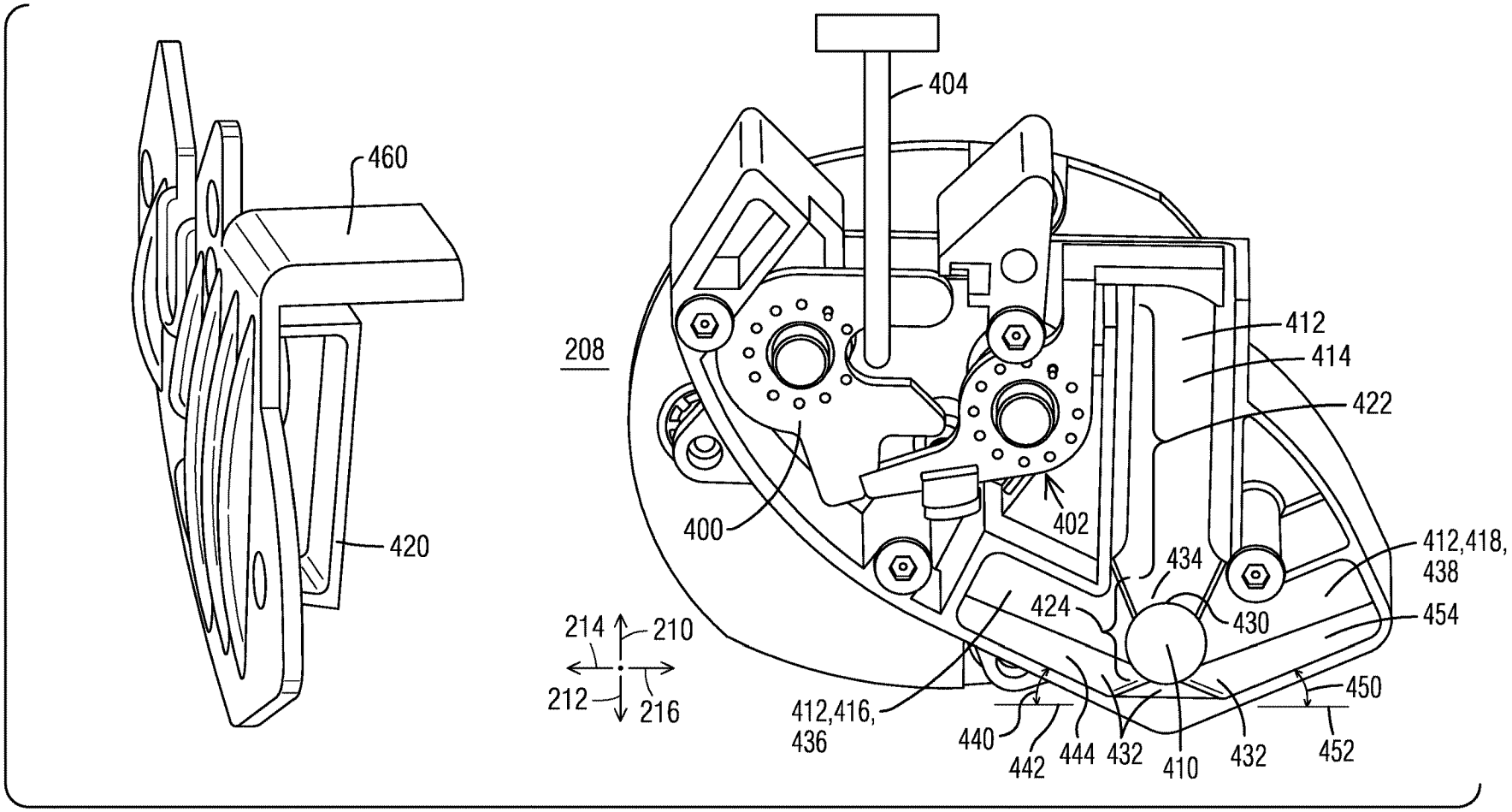
FIG. 4 shows the hasp assembly of FIG. 3 with the hasp in an engaged position and engaging a staple.

FIG. 4 shows the hasp assembly of FIG. 3 after the hasp 302 has rotated in the clockwise direction 312 enough for the actuator catch 324 to engage the hasp recess 316. The engagement occurs due to the upward bias on the actuator catch 324 caused by the bias of the actuator 320, and the rightward bias of the hasp tab 314 caused by the bias of the hasp 302. When the hasp 302 is in this engaged hasp position 400, and the actuator 320 is in this actuator engaged position 402, the hasp 302 secures the staple 404 so that the staple 404 cannot be removed unless the manual release mechanism 100 is manually activated or the container 108 is rotated in the forward direction 210 from the upright orientation 208 sufficiently.

Although this embodiment includes the hasp 302 and the actuator 320 and their associated features and springs, those of ordinary skill in the art will understand that other arrangements may be used to releasably engage the staple. For example, linear springs may be used instead of coil springs, recesses and catches may be reversed, and the hasp may operate in the opposite direction etc.

Also visible is a kinetic element 410. In this embodiment, the kinetic element is spherical, but it may take any shape so long as the kinetic element can move about under the influence of gravity. The kinetic element 410 is disposed in a chamber 412 having a release passage 414, a left trap 416 extending laterally and upward, a right trap 418 extending laterally and upward, and a back trap (not visible) extending laterally and upward. Collectively, the traps are designated a trap arrangement. The back trap is formed when a projection 420 located on the cover 300 projects into an upper part 422 of the chamber 412 but not into a lower part 424 of the chamber 412. The back trap is formed under the projection 420 and behind (out of the page in FIG. 4) the kinetic element 410 when the kinetic element is in a home position 430 as shown in FIG. 4. The back trap can be seen more clearly in FIG. 5. However, the back trap may be formed as part of the interior of the hasp assembly 200, and/or the side traps 416, 418 may be formed as part of the cover 300. The specific construction chosen is subject to design preference. The release passage 414 and the traps are shown with a rectilinear cross section but may take any shape as a matter of design choice. Similarly, the release passage 414 and the traps are shown as being straight, but may be curved or jointed, or flared or narrowed as desired to achieved a desired effect associated there with.

The kinetic element 410 rests in the home position 430 when the container 108 and the hasp assembly 200 are in the upright orientation 208 by virtue of angled surfaces 432 that urge the kinetic element against a release passage forward wall 434 that leads to the release passage 414. The kinetic element 410 can access the release passage 414 and all traps directly from the home position 430, and the kinetic element 410 is free to move about the chamber 412 in response to changes in orientation of the chamber 412 due to changes in orientation of the hasp assembly 200. A left trap forward wall 436 and a right trap forward wall 438 may be inclined with respect to the release passage forward wall 434 in order to provide a funneling effect that urges the kinetic element toward the release passage forward wall 434 and the home position 430.

If the hasp assembly 200 rotates in the sideways left direction 214 (counterclockwise as seen in FIG. 4) from the upright orientation 208 a sufficient amount, the kinetic element 410 will enter the left trap 416 and stay there through continued leftward (counterclockwise) rotation up to and over 180 degrees. The amount of leftward rotation that constitutes a sufficient amount is a matter of design choice and depends on an angle 440 between a horizontal line 442 and a bottom surface 444 of the left trap 416. For example, if the angle 440 is fifteen (15) degrees, then the left sideways threshold angle is fifteen (15) degrees and so leftward rotation of over fifteen (15) degrees will cause gravity to draw the kinetic element 410 into the left trap 416. A range of acceptable values for angle 440 includes over zero degrees to just under ninety (90) degrees.

If the hasp assembly 200 rotates in the sideways right direction 216 (clockwise as seen in FIG. 4) from the upright orientation 208 a sufficient amount, the kinetic element 410 will enter the right trap 418 and stay there through continued rightward (clockwise) rotation up to and over 180 degrees. As for the left trap 416, the amount of rightward rotation that constitutes a sufficient amount is a matter of design choice and depends on an angle 450 between a horizontal line 452 and a bottom surface 454 of the right trap 418. A range of acceptable values for angle 450 includes over zero degrees to just under ninety (90) degrees. For example, if the angle 450 is fifteen (15) degrees, then the right sideways threshold angle is fifteen (15) degrees and so rightward rotation of over fifteen (15) degrees will cause gravity to draw the kinetic element 410 into the right trap 418.

In an embodiment, there may be a lock or adjustable stop (not shown) installed in the hasp assembly 200 that prevents the release element 410 from actuating when the kinetic element 410 impacts it. For example, a key or combination lock, or stop mechanism, may be installed in a landing 460 of the cover such that when in the locked position the lock or stop may prevent movement of the release element 328. Such a feature may be useful when no collection is expected. For example, the lock may remain locked in the days prior to an expected collection and unlocked immediately prior to the collection, thereby eliminating the chance of the container 108 being opened unless the manual release mechanism 100 is activated.

Figure 5:
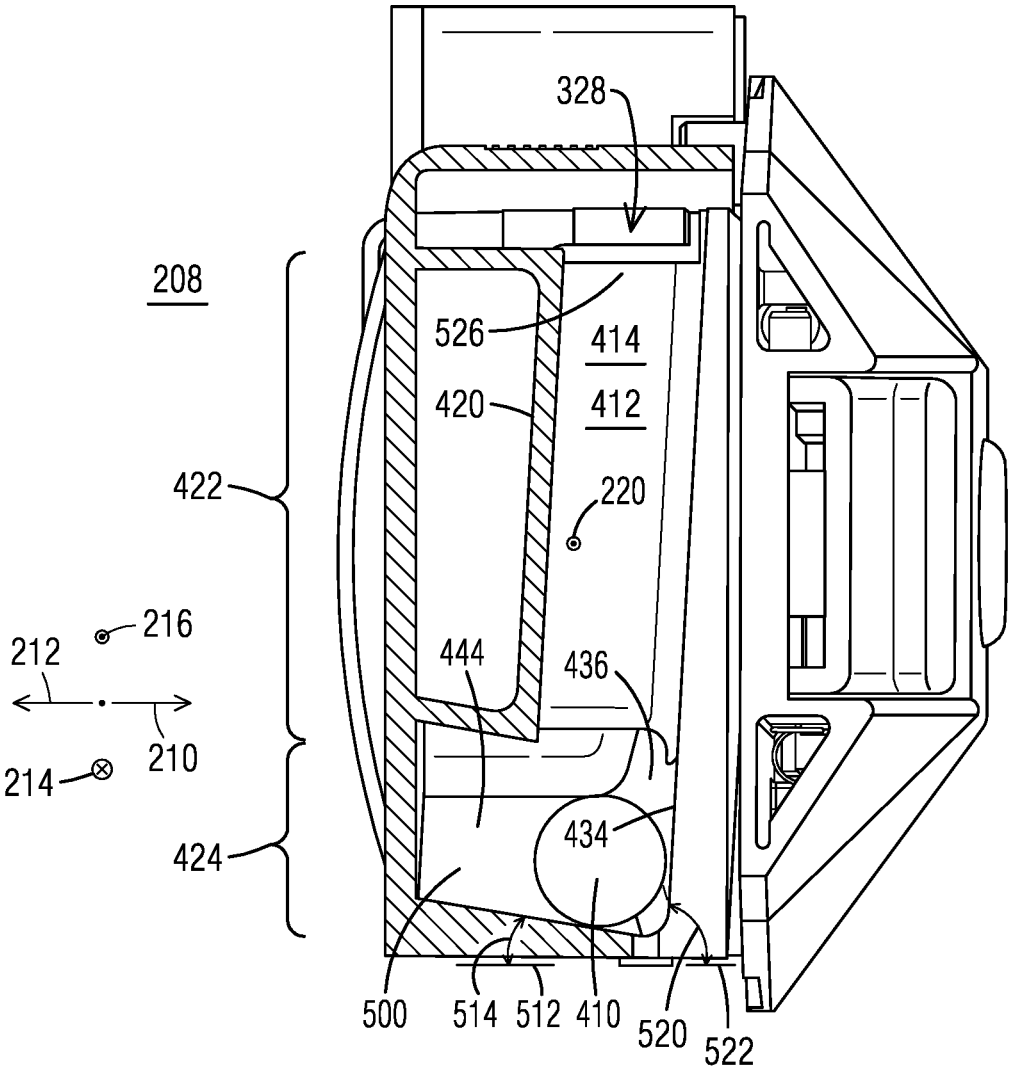
FIG. 5. is a cross sectional view of the hasp assembly of FIG. 2 along line A-A.

FIG. 5. is a cross sectional view of the hasp assembly 200 of FIG. 2 along line A-A, showing the chamber 412 with the cover 300 and its associated projection 420 in place. The projection 420 can be seen projecting into the upper part 422 of the chamber 412 but not into the lower part 424 of the chamber 412. The volume below the projection 420 is the back trap 500. If the hasp assembly 200 rotates in the backward direction 212 (counterclockwise in FIG. 5) from the upright orientation 208 a sufficient amount, the kinetic element 410 will enter the back trap 500 and stay there through continued backward rotation up to and over 180 degrees. As for the left trap 416 and the right trap 418, the amount of rightward rotation that constitutes a sufficient amount is a matter of design choice and depends on an angle 510 between a horizontal line 512 and a bottom surface 514 of the back trap 500. For example, if the angle 510 is fifteen (15) degrees, then the backward threshold angle is fifteen (15) degrees and so backward rotation of over fifteen (15) degrees will cause gravity to draw the kinetic element 410 into the back trap 500. A range of acceptable values for angle 510 includes over zero degrees to just under ninety (90) degrees.

For all traps, resetting the hasp assembly 200 by returning the hasp assembly 200 to the upright orientation 208 will return the kinetic element 410 to the home position 430.

Alternately, the angles 440, 450, and 510 may include zero. In such an embodiment, the kinetic element 410 is free to move about horizontally within the chamber 412, but would move toward the release passage forward wall 434 upon an initiation of rotation in the forward direction 210, and then into the release passage 414 with continued forward rotation. In this embodiment, the home position would be expanded to include those volumes where the kinetic element 410 might find itself when the container 108 is in the upright orientation 208.

If the hasp assembly 200 rotates in the forward direction 210 (clockwise in FIG. 5) from the upright orientation 208 a sufficient amount, the kinetic element 410 will enter the release passage 414, travel toward, and eventually impact the release element 328 disposed in the release passage 414. In an embodiment, the release element 328 is disposed at an end 526 of the release passage 414, but it can be anywhere therein. Should the kinetic element 410 impact the release element with sufficient momentum, the release element 328 will be moved along the direction of travel of the kinetic element 410. This movement will cause the actuator 320 to rotate in the counterclockwise direction 330 which disengages the actuator catch 324 from the hasp recess 316. This disengagement frees the hasp 302 to rotate with its bias back to the disengaged hasp position 304. (See FIGS. 3 and 4). This, in turn, releases the staple 404, freeing the lid and allowing the contents of the container 108 to exit the container 108.

As with the traps, the amount of forward rotation that constitutes a sufficient amount is a matter of design choice and depends on an angle 520 between a horizontal line 522 and the release passage forward wall 434 of the release passage 414. In an embodiment, the angle 520 is at least one hundred (100) degrees, in which case the forward threshold angle would be the same at least one hundred (100) degrees. A range of acceptable values for angle 560 includes virtually any value over zero degrees, and in particular, over one hundred (100) degrees. Ideally, the angle 520 is selected so that the hasp assembly will retain the staple 404 therein until a convincing amount of forward rotation occurs, but releases the staple 404 before contents in the container 108 shift and press on the lid, possibly interfering with the operation of the hasp assembly 200 thereafter.

In an embodiment, the angles 440, 450, and 510 are less than angle 520 to ensure the kinetic element 410 is trapped by an undesirable rotation before having a chance to enter the release passage 414.

The kinetic element 410 must impact the release element 328 with sufficient momentum to overcome the engagement between the actuator catch 324 from the hasp recess 316. This prevents release in instances such as the container 108 simply falling over. The threshold amount of momentum is a design choice and can be controlled by controlling the biasing force exerted by the respective spring on the hasp 302, the biasing force exerted by the respective spring on the actuator 320, and a geometry of the actuator catch 324 from the hasp recess 316 et al. Generating the threshold amount of momentum is also a matter of design choice and can be accomplished by proper selection of mass and weight of the kinetic element 410, the angle 520, a length of the release passage 414, and a leveraging distance from the actuator stud 332 that the kinetic element 410 contacts the release element 328 et al. In an embodiment, the kinetic element is composed of metal and has a diameter of 0.75 Inches.

Figure 6:
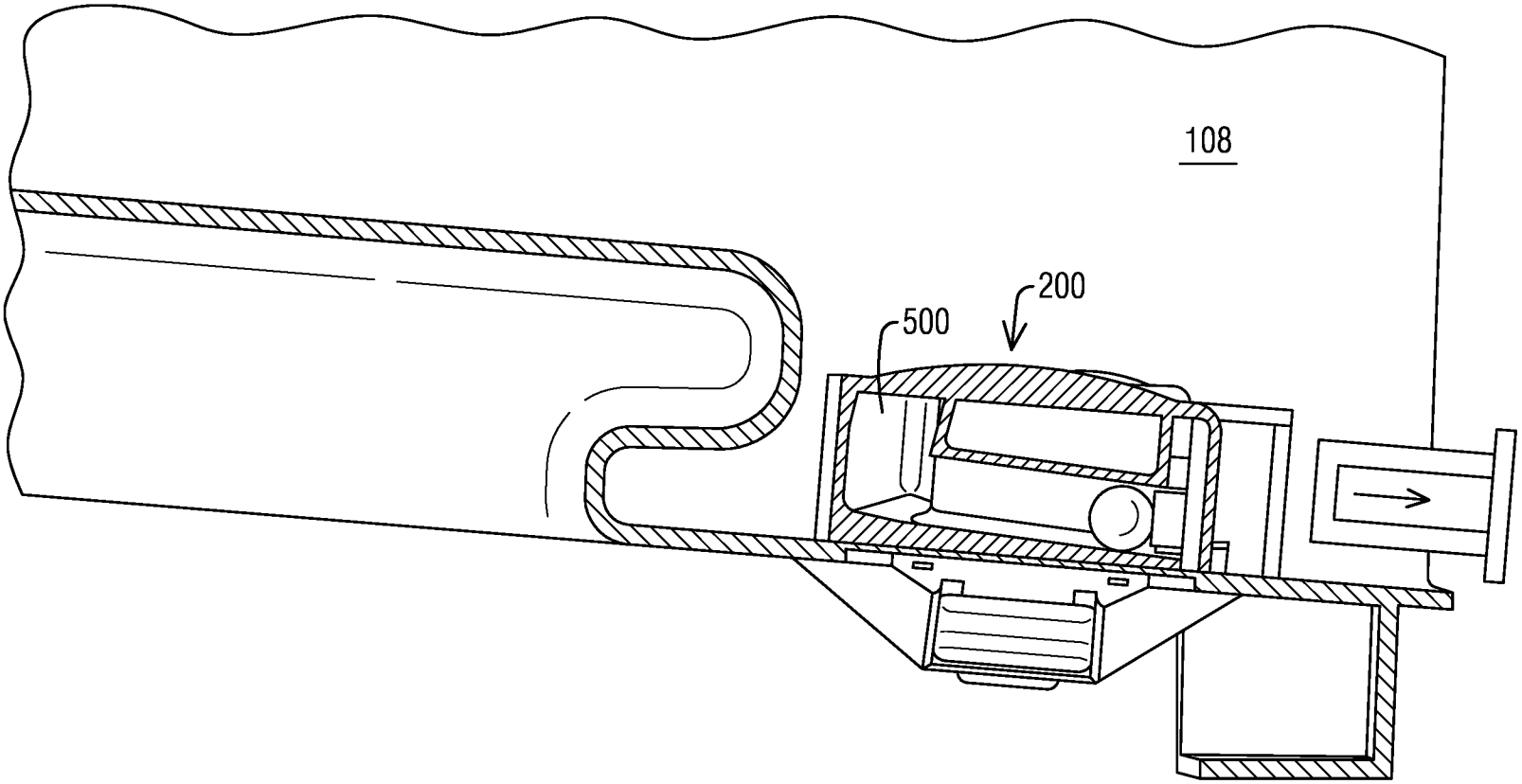
FIG. 6 is a cross sectional view of the hasp assembly and container of FIG. 2 after forward rotation has released the staple.

FIG. 6 is a cross sectional view of the hasp assembly 200 and container 108 after sufficient rotation in the forward direction 210 has enabled gravity to draw the kinetic element 410 into and down the release passage 414 until the kinetic element has struck the release element 328, thereby causing the hasp assembly 200 to release the staple 404 in the manner described above. With the staple 404 and associated lid released, the contents of the container 108 are free to exit the container 108.

With the hasp 302 in the disengaged hasp position 304 by virtue of the staple releasing process described above, the hasp 302 is again ready to receive the staple 404. Returning the container 108 to the upright orientation 208 by reversing the tilt will reset the kinetic element 410 to the home position 430, lower the staple 404 into the hasp 302, and cause the hasp to again secure the staple 404 and lid in the hasp assembly 200.

If the container 108 and hasp assembly 200 were instead rotated in the backward direction 212 from the upright orientation 208, the kinetic element 410 would instead be drawn by gravity into the back trap 500, thereby locking the kinetic element 410 until the container 108 is returned to the upright orientation 208.

Figure 7:
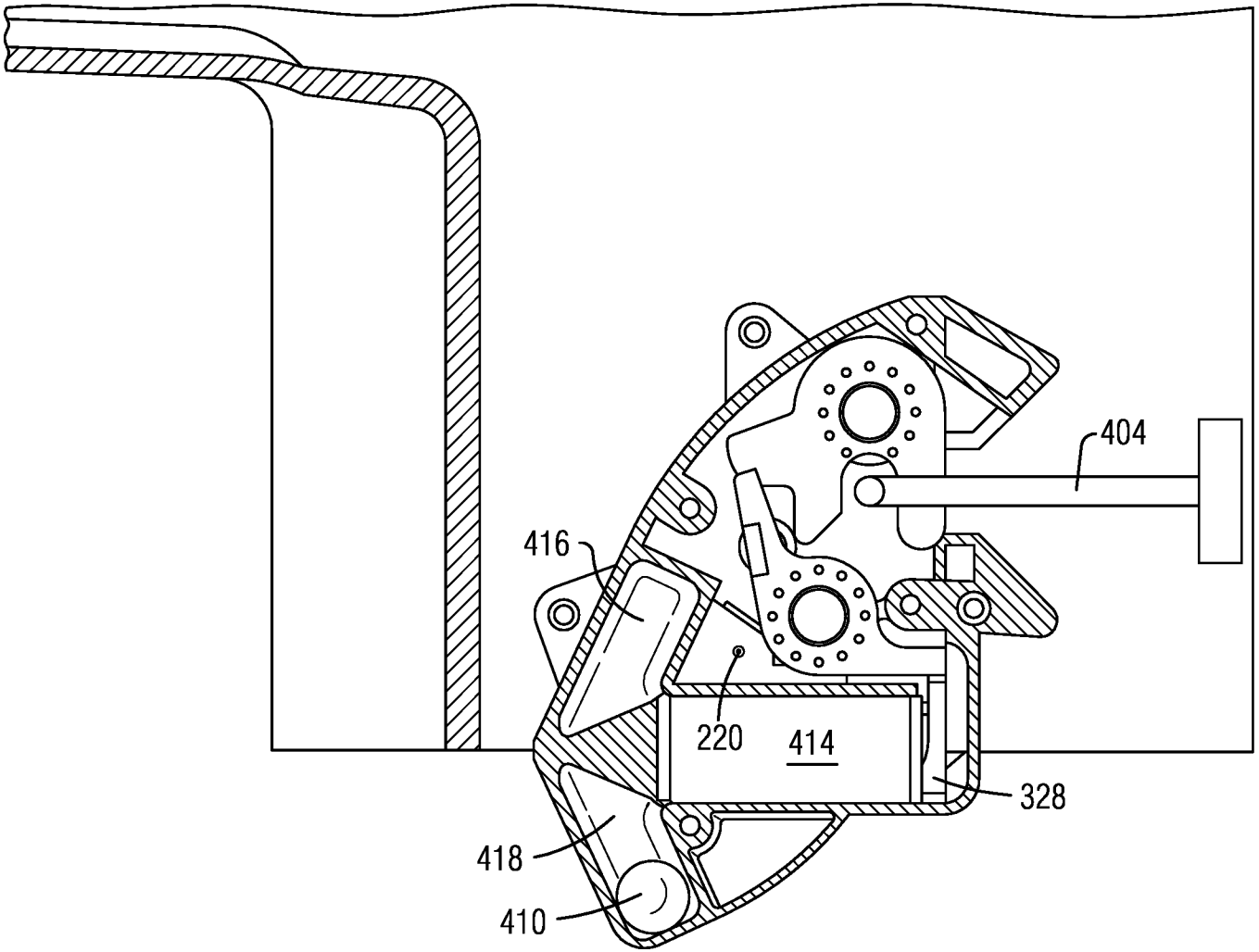
FIG. 7 is a cross sectional view of the hasp assembly and container of FIG. 2 after sideways rotation with the hasp still engaging the staple.

FIG. 7 is a cross sectional view of the hasp assembly 200 and container 108 after sufficient rotation in the sideways right direction 216 has enabled gravity to draw the kinetic element 410 into the right trap 418. With the kinetic element 410 trapped in the right trap 418, the release element 328 is untouched and the staple 404 is not released, but instead remains secured in the hasp assembly 200. From this orientation, rotation in the forward direction 210 would not result in a release of the staple 404 because the kinetic element 410 remains trapped in the right trap 418. In order to release the staple 404 after the kinetic element 410 is trapped in this manner, the kinetic element 410 must be returned to the home position 430, which may be accomplished by simply returning/resetting the container 108 to the upright orientation 208, and then causing the necessary rotation in the forward direction 210. In the embodiment shown the same principles apply to the hasp assembly 200 after sufficient rotation in the sideways left direction 214 due to the symmetry shown between the right trap 418 and the left trap 416 about the release passage 414.

Figure 8:
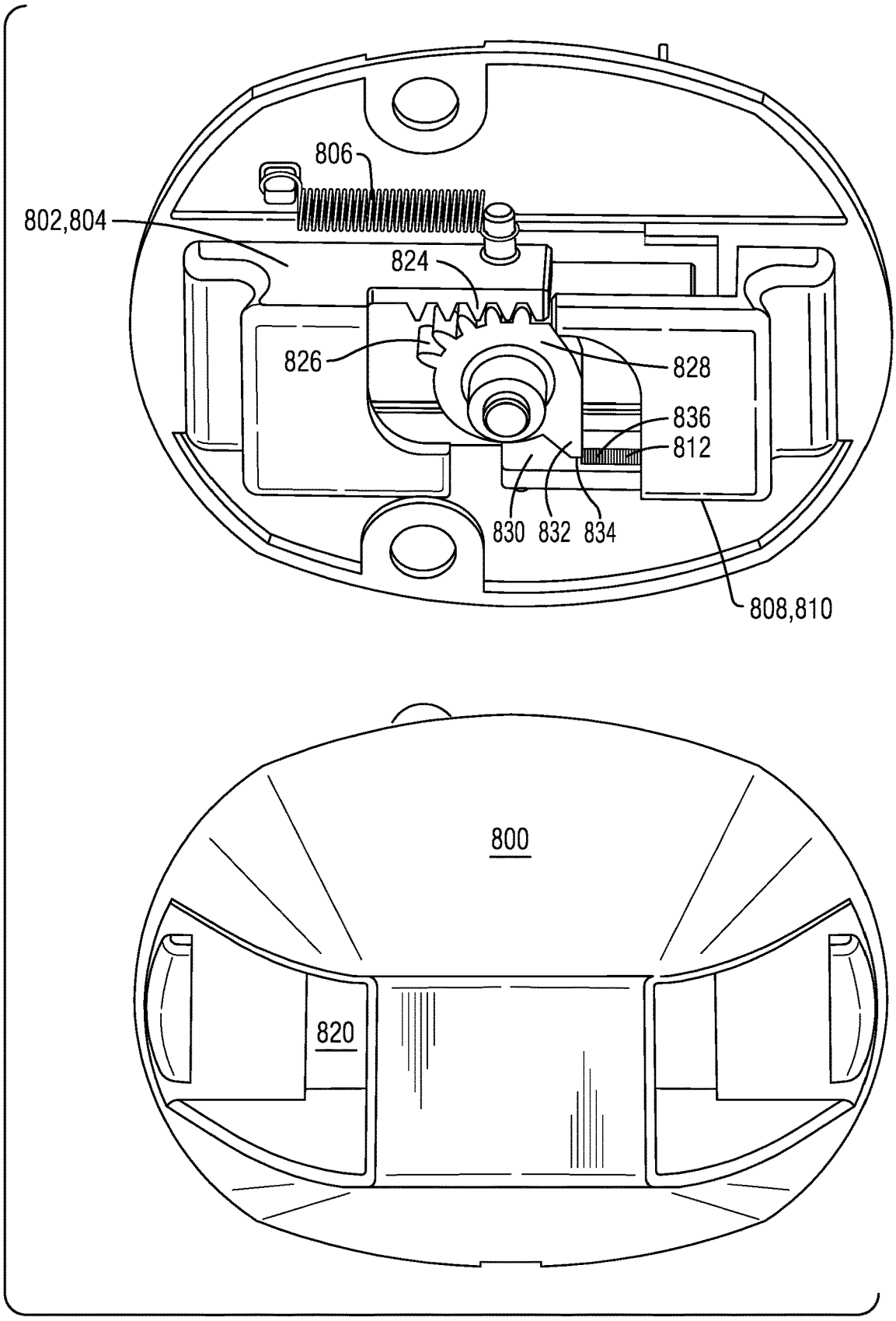
FIG. 8 shows the manual release mechanism of FIG. 1 with the cover removed and the buttons in the closed position.

FIG. 8 shows the manual release mechanism 100 with a cover 800 removed and a left button 802 biased into a left button closed position 804 by a left spring 806, and a right button 808 biased into a right button closed position 810 by a right spring 812. The buttons 808, 808 are arranged to fit inside a recess 820 in the cover 800, and the recess 820 permits linear movement of the buttons 802, 808 therein. In the embodiment shown, the left button 802 includes a rack gear 824 that engages a spur gear 826 on an intermediate element 828. Accordingly, movement of the left button 802 from the left button closed position 804 rotates the intermediate element 828 clockwise when the intermediate element 828 is free to rotate. Rotation of the intermediate element 828 causes the haps assembly 200 to release the staple 404.

In the embodiment shown, the right button 808 includes a button tab 830 that abuts an element tab 832 at an interface 834 when the right button 808 is in the right button closed position 810. Movement of the right button 808 from the right button closed position 810 moves a button recess 836 adjacent to the element tab 832. This movement eliminates the interface 834 which frees the intermediate element 828 to rotate, but has no other effect on the intermediate element 828. Movement of the left button 802 from the left button closed position 804 (and associated rotation of the intermediate element 828) is thereby blocked by the right button 808 when the right button 808 is in the right button closed position 810. Movement of the right button 808 from the right button closed position 810 does not cause movement of the intermediate element 828. Accordingly, both buttons 802 808 must be moved to effect movement of the intermediate element 828 and thereby manually release the staple 404. This movement may be simultaneous and/or the right button 808 may be moved first.

Figure 9:
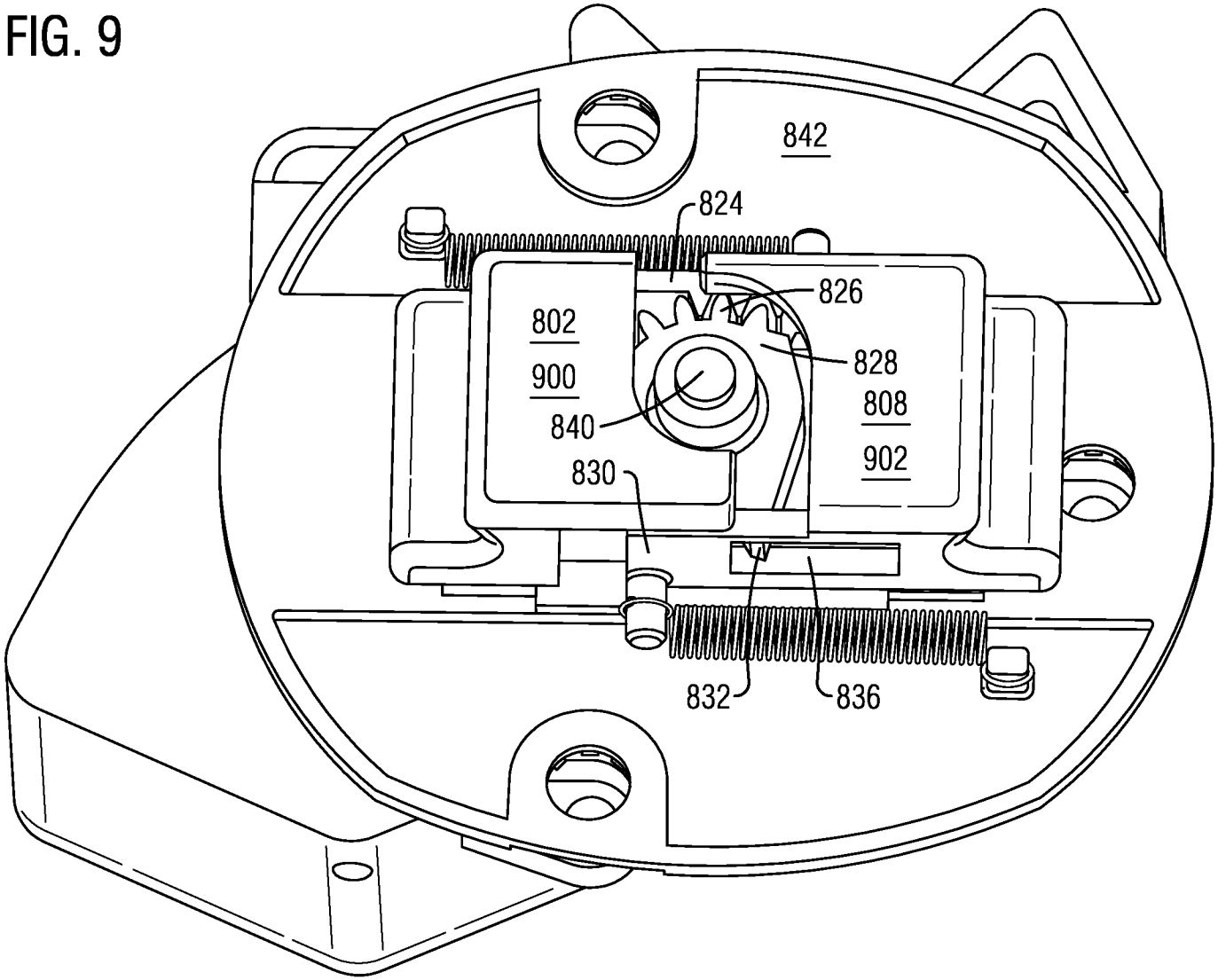
FIG. 9 shows the manual release mechanism of FIG. 1 with the cover removed and the buttons moved toward the open position.

FIG. 9 shows the manual release mechanism 100 with the cover 800 removed, the left button 802 moved to a left button open position 900, and the right button 808 moved to a right button open position 902. The movement of the right button 808 has freed the intermediate element 828 to rotate. The movement of the left button 802 has caused the intermediate element 828 to rotate. A shaft 840 of the intermediate element 822 extends through a plate 842 of the manual release mechanism 100 and into the hasp assembly 200, and rotation of the shaft 840 causes the hasp assembly 200 to release the staple 404. Moving both buttons 802, 808 toward each other in this pinching manner is natural for humans and yet hard for wildlife to accomplish. This reduces the chances that wildlife will activate the manual release.

Figure 10:
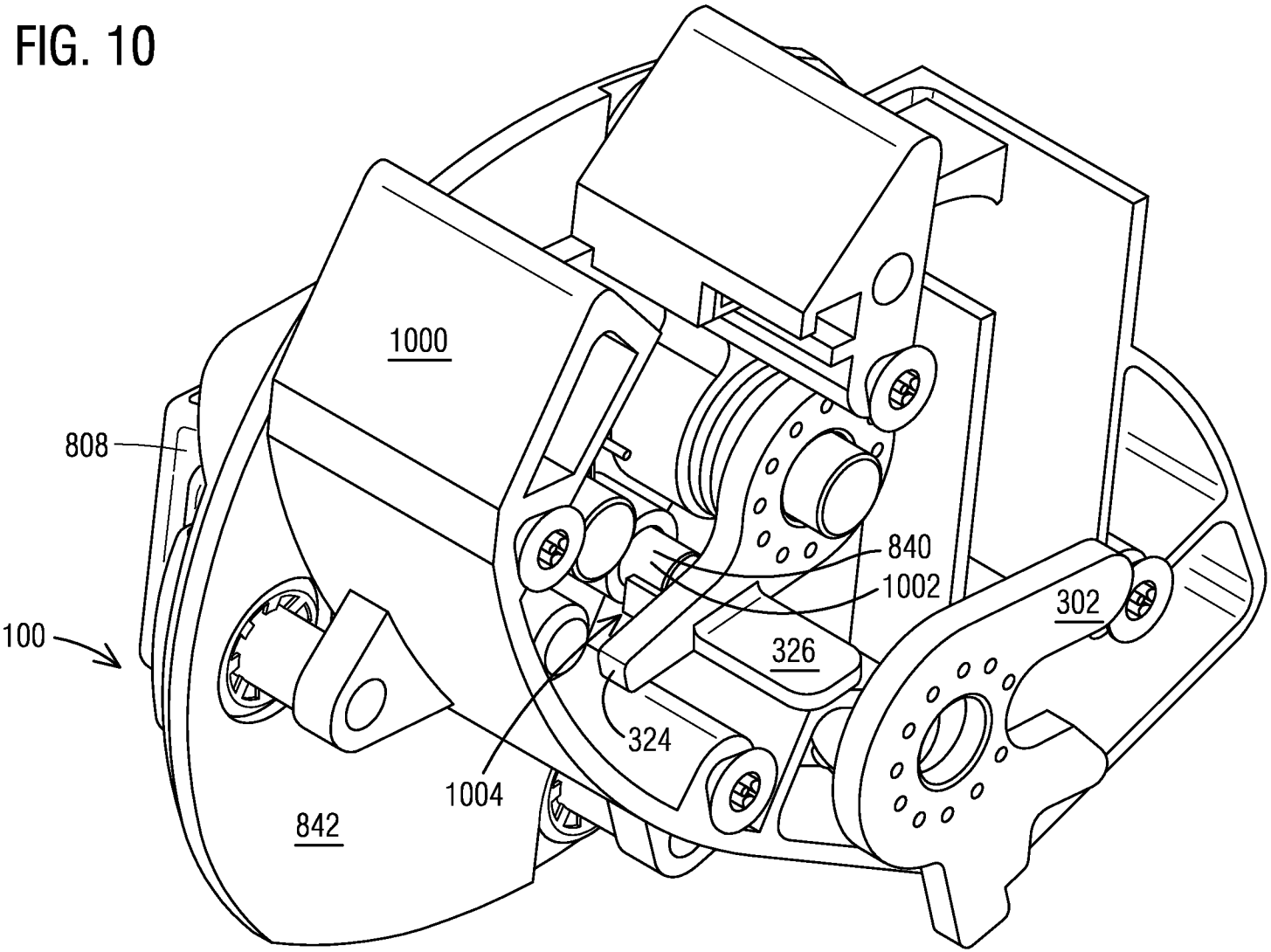
FIG. 10 is a perspective view of the hasp assembly of FIG. 4.

FIG. 10 is a perspective view of the hasp assembly 200 showing a backside of the manual release mechanism 100 with the hasp 302 moved to make visible the shaft 840 of the intermediate element 828 where it passes through a housing 1000 of the hasp assembly 200. A shaft feature 1002 on the shaft 840 interacts with an actuator feature 1004 in a manner that causes the actuator catch 324 to lower and thereby disengage the hasp 302 when the intermediate element 828 is rotated by the manual release mechanism 100. In the embodiment shown the shaft feature 1002 is an eccentric projection that presses down on the actuator feature 1004 when the intermediate element 828 is rotated.

Manual release is also enabled by the internal release tab 326 that extends through the internal side opening 340 of the cover 300. From the inside of the container 108, simply lowering the internal release tab 326 lowers the actuator catch 324, thereby disengaging the hasp 302 and releasing the staple 404.

Figure 11:
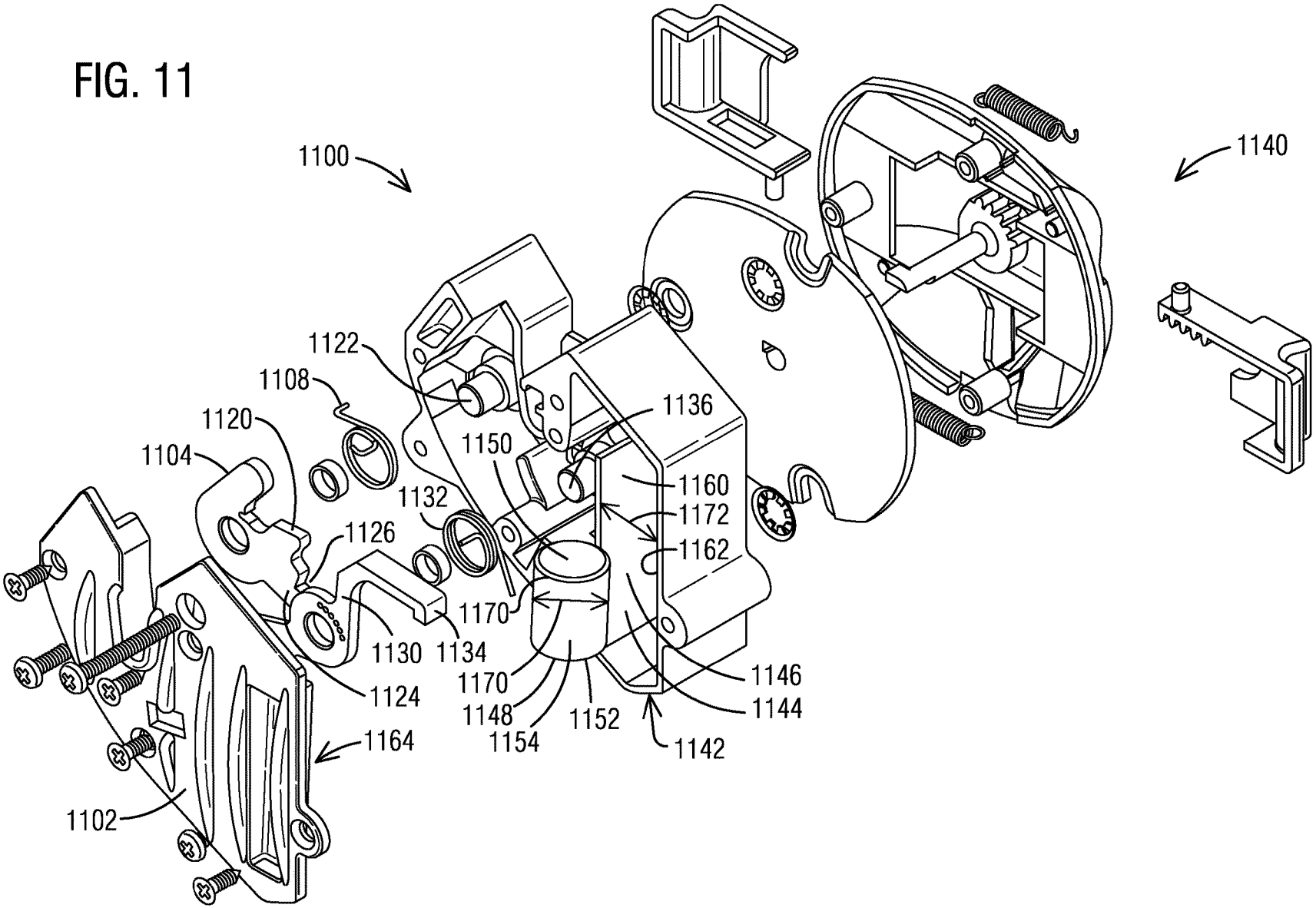
FIG. 11 is a perspective exploded view of an alternate example embodiment of the hasp assembly.

FIG. 11 is a perspective exploded view of an alternate example embodiment of the hasp assembly. FIG. 11 shows the hasp assembly 1100 with a cover 1102 removed and the hasp 1104, a hasp coil spring 1108 behind the hasp 1104, the contact area 1120 of the hasp 1104, the hasp stud 1122, and the hasp tab 1124, the hasp recess 1126. Also visible are the actuator 1130, the actuator coil spring 1132 behind the actuator 1130, the release element 1134, and the actuator stud 1136. These elements operate under the same principles as in the embodiments of FIGS. 1-10, as does the manual release mechanism 1140. An end of the actuator coil spring 1132 can be inserted into any of a number of bores in the release element 1134. Each bore provides a different amount of bias for the release element 1132 against being moved by the kinetic element 1148. The hasp 1104 may likewise have a number of bores into which an end of the hasp coil spring 1108 may be inserted. Each bore provides a different amount of bias of the hasp 1104 into the disengaged hasp position. (See FIGS. 3, and 4).

The embodiment of FIG. 11 is similar to that of FIGS. 1-10 in that there is a chamber 1142 that includes a home position 1144 and a release passage 1146, the release element 1134 is disposed at an end of the release passage 1146, and the kinetic element 1148 is disposed in the chamber 1142. However, in the embodiment of FIG. 11 there is no left trap, no right trap, and no back trap. When tilted forward from the upright position a threshold amount or more, the kinetic element 1148 moves in the release passage 1146 from the home position 1144 toward the release element 1134 until the kinetic element 1148 contacts the release element 1134. If the kinetic element 1148 carries enough momentum, then contacting the release element 1134 will cause the release element 1134 to release the staple. As with the embodiments if FIGS. 1-10, the amount of momentum is a matter of design choice.

The amount of momentum can be controlled by controlling various factors, including the size, density, and shape of the kinetic element 1148, the surface texture of the kinetic element 1148, and a surface of the release passage 1146 on which the kinetic element 1148 moves. In an example embodiment, the kinetic element 1148 of this embodiment is spherical. In the example embodiment shown in FIG. 11, the kinetic element 1148 is cylindrical, comprising a first end 1150, a second end 1152, and a curved side 1154 therebetween.

When cylindrical, the kinetic element 1148 may be positioned in the release passage 1146 so that the first end 1150 leads as the kinetic element 148 moves in the release passage 1146 toward the release element 1134. The kinetic element 1148 may take on other shapes, such as rectangular, square, etc. Unexpectedly, when the kinetic element 1148 is not spherical, and when the kinetic element 1148 is sized properly with respect to the release passage 1146, the kinetic element resists movement along the release passageway when the bin is tilted in a rough manner, for example, when knocked over. However, when the bin is tilted in a smooth manner, such as by a collection truck lifting and tilting the bin during the collection process, the kinetic element 1148 moves easily in the release passage 1146 toward the release element 1134. While not being bound to a particular theory, it is believed that when the bin is tilted in a rough manner, the kinetic element 1148 vibrates and/or bounces in the release passage 1146, and this vibration/bouncing slows down and/or stops the kinetic element 1148 from moving in the release passage 1146 toward the release element 1134. In contrast, the lifting and tilting of the bin during the collection process is smooth, so the collection process does not cause the kinetic element 1148 to vibrate/bounce. Consequently, the kinetic element 1148 moves freely during the collection process and the lid is released.

In this example embodiment, a cross section of the kinetic element 1148 is circular, while a cross section of the release passage 1146 is quadrilateral (e.g. square). Consequently, the respective cross sections may be different, but they may be the same as well. An amount of clearance between the kinetic element 1148 and the release passage 1146 can also be controlled to control the responsiveness of the kinetic element 1148 in the release passage 1146. For example, a relatively large clearance can be used to loosen of the movement of the kinetic element 1148, whereas a relatively small clearance can be used to restrict the movement. However, a clearance that is too small may prevent the necessary vibration/movement, thereby loosening up the kinetic element 1148. In an example embodiment, a diameter 1170 of the kinetic element 1148 may be smaller than a width 1172 (and depth) of the release passage 1146 by one (1) millimeter. In an example embodiment, a range of 0.5 millimeters to 2.0 millimeters may be used.

Further, and interaction of the kinetic element 1148 with the walls 1160, 1162, 1164 of the release passage 1146 can be controlled to control the responsiveness of the kinetic element 1148. For example, the kinetic element shown comprises a chamfer 1170 at each end 1150, 1152. The chamfer 1170 may be omitted, which would leave relatively sharp corners 1176 that would better grip the walls 1160, 1162, 1164 during vibration/bouncing, thereby mitigating movement of the kinetic element 1148 in the release passage 1146. When the chamber is 1170 is present, an amount and a geometry (angle) of the chamfer 1170 may be controlled to control the interaction of the kinetic element 1148 with the walls, 1160, 1162, 1164, thereby controlling the responsiveness of the kinetic element 1148.

Additionally, a ratio of a length to diameter (or width) of the kinetic element 1148 may be controlled to control an amount of misalignment that can occur between the kinetic element 1148 and the release passage 1146 during the vibration/bouncing. For example, a relatively long kinetic element 1148 will remain more aligned within the release passage 1146 than will a relatively short kinetic element 1148. More misalignment of the relatively shorter kinetic element 1148 may cause the corners 1176 to bite more, thereby inhibiting movement of the kinetic element 1148 when compared to a relatively longer kinetic element 1148.

Figure 12:
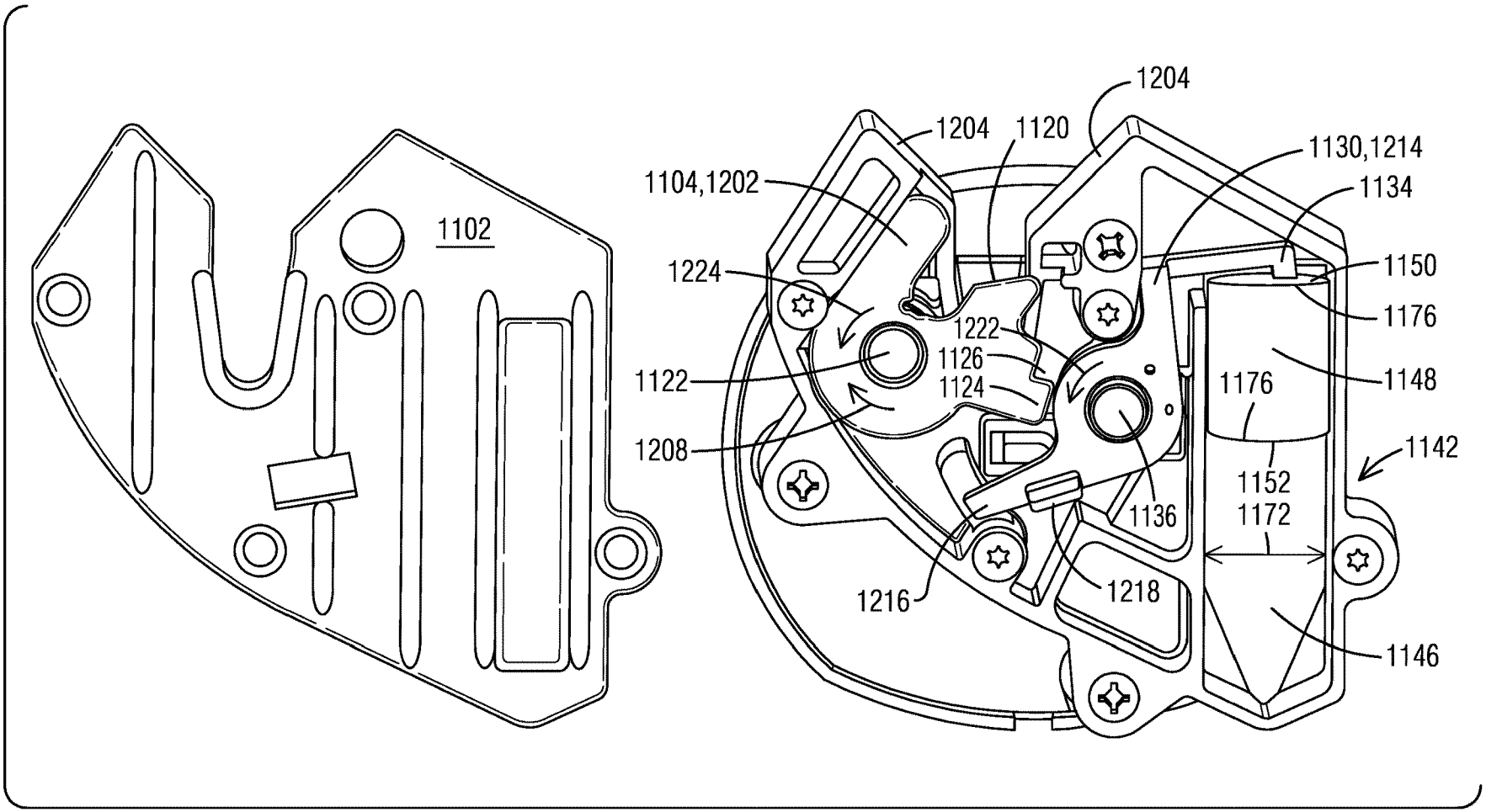
FIG. 12 shows the hasp assembly of FIG. 11 with a cover removed and the hasp in the disengaged position.

Similarly, the walls, 1160, 1162, 1164 may be designed to exhibit a certain amount of resilience that cooperates with the kinetic element 1148 to promote or reduce (e.g. to control) the vibration/bounce. Additionally, the walls 1160, 1162, 1164 may be designed to exhibit a certain amount of softness to control an amount of bite the corners 1176 of the kinetic element 1148 take when vibrating/bouncing. FIG. 12 shows the example embodiment of FIG. 11 with the cover 1102 removed and the hasp 1104 biased into the disengaged hasp position 1202 by, for example, the hasp coil spring 1108 behind the hasp 1104. When closing the lid of the bin, the optional ramps 1204 guide the staple into the hasp 1104 as the lid is closed. Once the staple abuts a contact area 1120 of the hasp 1104, continued lowering of the lid (and staple) causes the hasp 1104 to rotate about the hasp stud 1122 in the clockwise direction 1208. The hasp 1104 includes the hasp tab 1124 and the hasp recess 1126.

The actuator 1130 is shown in an impacted actuator position 1214 which happens during the collection process when the kinetic element 1148 impacts the actuator 1130 upon an appropriate tilting of the bin. The actuator 1130 includes the actuator catch 1216, the internal release tab 1218, and the release element 1134. The momentum of the kinetic element 1148 has moved the release element 1134 upward (as seen in FIG. 12), which rotated the actuator 1130 in a counterclockwise direction 1222, which disengaged the actuator catch 1216 from the hasp recess 1126, thereby freeing the hasp 1104 to rotate in a counterclockwise direction 1224 into the disengaged hasp position 1202 shown in FIG. 12, releasing the staple.

The innovative mechanism disclosed herein secures a container is a unique and innovative manner to ensure that the container remains secured until such time as a human manually releases it, or the container undergoes a rotation consistent with that experienced during a collection process. Further, the container enters a locking mode that requires a resetting to the upright orientation before the container can be opened if other rotation occurs. These characteristics are novel and unique and therefore represent an improvement in the art.

This written description uses examples to disclose embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An apparatus, comprising:

a staple;

a hasp configured to receive the staple;

a housing that defines a chamber comprising a home position and a release passage, wherein the housing also encloses the hasp;

a kinetic element disposed in the chamber; and an actuator that comprises a release element that disengages the hasp after forward rotation of the apparatus from an upright orientation allows the kinetic element to slide under an influence of gravity from the home position along the release passage and into contact with the release element, thereby releasing the staple; and wherein the kinetic element comprises a cylindrical shape comprising a leading face and a trailing face so that the leading face of the kinetic element leads while the kinetic element slides toward the release element until the leading face contacts the release element.

2. The apparatus of claim 1, the apparatus further comprising a manual release mechanism operatively connected to the actuator and comprising a first button and a second button, wherein only when both the first button and the second button are depressed does the manual release mechanism releases the staple.

3. The apparatus of claim 2, wherein when depressed the first button moves toward the second button, and wherein when depressed the second button moves toward the first button.

4. The apparatus of claim 2, wherein the manual release mechanism is configured to be mounted on an exterior of a front of a container.

5. The apparatus of claim 1, wherein the housing is configured to be mounted on an inside of a front of a container that is designed to be rotated forward to be emptied, and the staple is configured to be mounted to a lid of the container.

6. The apparatus of claim 1, further comprising a cover over the housing, wherein the release element comprises an internal release accessible through the cover and which enables a user to manually operate the release element and thereby release the staple.

7. The apparatus of claim 1, further comprising an adjustable spring configured to bias the release element against being moved by the kinetic element, wherein an amount of the bias is adjustable.

8. The apparatus of claim 1, wherein a clearance between the kinetic element and walls of the release passage falls within 0.5 mm and 1.0 mm.

9. The apparatus of claim 8, wherein the clearance is 1.0 mm.

10. An apparatus, comprising:

a staple; and a hasp assembly comprising: a hasp configured to engage the staple; a chamber comprising a release passage and a home position at an end thereof; a kinetic element disposed in the chamber; and a release element disposed in the release passage and operatively associated with the hasp;

wherein when the hasp assembly is in an upright orientation gravity urges the kinetic element into the home position;

wherein the home position and the release passage are configured such that the kinetic element is held under an influence of gravity in the home position until the hasp assembly experiences a forward rotation of at least a threshold amount, at which orientation the kinetic element moves into the release passage; and wherein the kinetic element comprises a cylindrical shape comprising a leading face and a trailing face so that the leading face of the kinetic element leads while the kinetic element slides toward the release element until the leading face contacts the release element, and wherein the contact disengages the hasp and thereby releases the staple.

11. The apparatus of claim 10, wherein the threshold amount is one hundred (100) degrees.

12. The apparatus of claim 10, further comprising a cover over the hasp assembly, wherein the release element comprises an internal release accessible through the cover and which enables a user to manually operate the release element and thereby release the staple.

13. The apparatus of claim 10, further comprising an adjustable spring configured to bias the release element against being moved by the kinetic element, wherein an amount of the bias is adjustable.

14. The apparatus of claim 10, further comprising an adjustable spring configured to bias the hasp toward a position that releases the staple, wherein an amount of the bias is adjustable.

15. The apparatus of claim 10, wherein a clearance between the kinetic element and walls of the release passage falls within 0.5 mm and 1.0 mm.

16. The apparatus of claim 10, the apparatus further comprising a manual release mechanism configured to be mounted on an exterior of a front of a container, operatively connected to the actuator, and comprising a first button and a second button, wherein only when both the first button and the second button are depressed does the manual release mechanism releases the staple.

17. The apparatus of claim 10, wherein the hasp assembly is configured to be mounted on an inside of a front of a container of a type that is designed to be rotated forward to be emptied, and the staple is configured to be mounted to a lid of the container.

* * * * *